United States Patent [19]

Kosar

[11] 4,391,068

[45] Jul. 5, 1983

[54] WATER DEFLECTOR

[76] Inventor: Walter F. Kosar, 103 Elmore Rd., Pittsburgh, Pa. 15221

[21] Appl. No.: 257,394

[22] Filed: Apr. 24, 1981

[51] Int. Cl.[3] ..... E04D 13/00

[52] U.S. Cl. ..... 52/97

[58] Field of Search ..... 52/97, 95, 94, 15, 366, 52/96, 91

[56] References Cited

U.S. PATENT DOCUMENTS

| | | | |
|---|---|---|---|
| 1,090,985 | 3/1914 | Hopkins | 52/96 |
| 1,276,632 | 8/1918 | Flagg | 52/94 |
| 1,470,331 | 10/1923 | Saul | 52/94 |
| 1,585,468 | 5/1926 | Covell | 52/94 |
| 4,148,164 | 4/1979 | Humphrey | 52/94 |

FOREIGN PATENT DOCUMENTS

| | | | |
|---|---|---|---|
| 2332394 | 7/1977 | France | 52/94 |

*Primary Examiner*—John E. Murtagh
*Assistant Examiner*—Michael Safavi
*Attorney, Agent, or Firm*—Webb, Burden, Robinson & Webb

[57] ABSTRACT

A deflector adapted to be mounted between overlapping shingles along the edge of a roof, and also a shingled roof in combination with such a deflector. The deflector includes a substantially flat base with a side edge and a front edge extending at an angle from said side edge, a first upstanding lip integral with said base along said side edge and substantially perpendicular to said base, and a second upstanding lip integral with said base along said front edge and integral with said first lip and substantially perpendicular to said base, said upstanding lips forming a continuous deflector lip adapted to deflect liquid.

7 Claims, 6 Drawing Figures

WATER DEFLECTOR

BACKGROUND OF THE INVENTION

1. Field of the Invention

This invention pertains to water deflectors, and more particularly to water deflectors which are secured between upper and lower overlapping shingles along the edge of a roof.

2. Description of the Prior Art

Roof gutters are well known in the art. Such gutters are usually mounted beneath the shingles along the end of a downward sloping roof and carry away rainwater which collects on and travels down the roof. Normally, gutters are needed only along the lower horizontal edge of a sloping roof and no rainwater will fall down the side of a house over any of the roof edges.

However, due to a particular roof configuration or to the presence of a draining downspout near the edge and at the top of a sloping roof, rainwater may collect and travel with a significant horizontal velocity across the roof rather than traveling only down the roof. When this occurs, water may fall over a downward sloping edge of a roof and down the house wall, causing inconvenience and possible damage to the house.

Accordingly, it is an object of the present invention to prevent water from traveling over the downward sloping edges of a roof. This overflow may be prevented by installing gutters along the downward sloping edges, but such gutters are expensive, difficult to install, and detract from the overall appearance of the roof.

It is a further object of the present invention to deflect water away from the downward sloping edges of a roof with a device which is inexpensive, easy to install, and which mounts directly to the roof and does not detract noticeably from the appearance of the roof.

It is yet another object of the present invention to deflect water away from the downward sloping edges of a roof by installing one or more water deflectors between overlapping shingles along the downward sloping edges of a roof.

SUMMARY OF THE INVENTION

The invention is a deflector which may be mounted between overlapping shingles along the edge of a roof, and also a shingled roof in combination with deflectors. The deflector includes a substantially flat base with a side edge and a front edge extending at an angle from the side edge, a first upstanding lip integral with the base at the side edge and substantially perpendicular to the base, and a second upstanding lip integral with the base at the front edge and integral wih the first lip and substantially perpendicular to the base; the upstanding lips form a continuous deflector lip adapted to deflect liquid. The base may include one or more raised tabs adapted to engage the lower surface of a shingle above the base, and may also include one or more holes therethrough which permit mastic to extend through the base and form a continuous bond between overlapping shingles and the base located therebetween. Preferably, the front edge extends at an obtuse exterior angle from the side edge.

DESCRIPTION OF THE PREFERRED EMBODIMENTS

Figure 1:
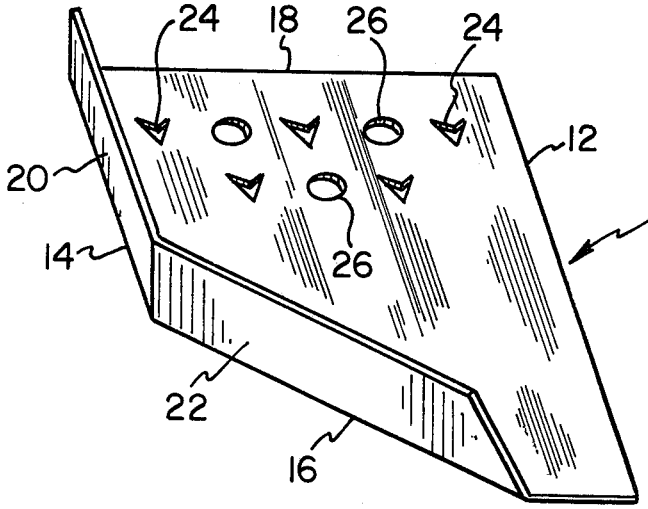
FIG. 1 is a perspective view of a water deflector in accordance with the present invention.
Figure 2:
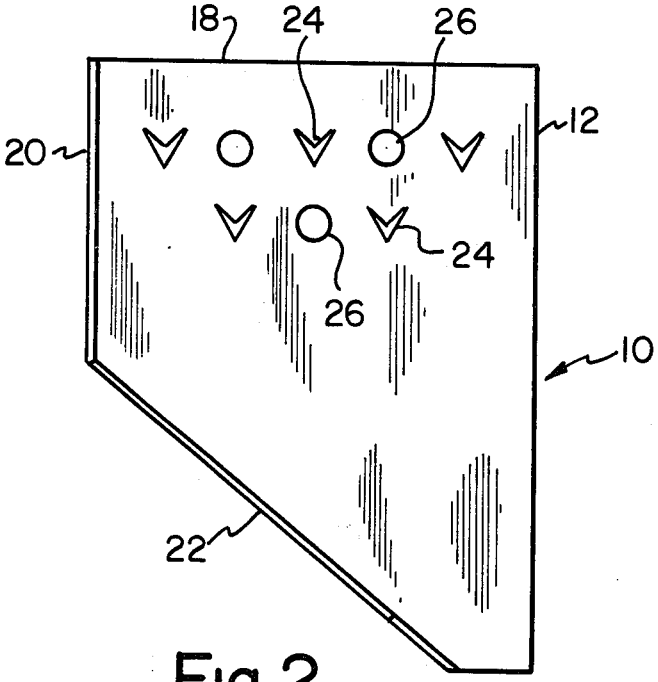
FIG. 2 is a top view of the water deflector of FIG. 1.
Figure 3:
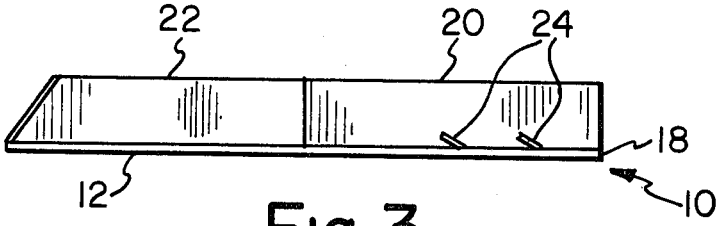
FIG. 3 is a side view of the water deflector of FIG. 1.

FIGS. 1–3 show a water deflector 10 for sloped shingled roofs in accordance with the present invention which includes a substantially flat trapezoidal-shaped base 12 with a side edge 14, a front edge 16 extending at an angle from the side edge 14, and a rear edge 18. Water deflector 10 also includes a first upstanding lip 20 integral with base 12 along side edge 14 and substantially perpendicular to base 12, and a second upstanding lip 22 integral with base 12 along front edge 16 and integral with upstanding lip 20 and substantially perpendicular to base 12. Upstanding lips 20 and 22 form a continuous deflector lip which deflects water away from the side edge 14 of the deflector 10. To most effectively deflect the water, the front edge 16 extends from the side edge 14 at an obtuse exterior angle. Upstanding lips 20 and 22 should be sufficiently high to deflect the expected water flow, yet not too high as to detract from the appearance of the roof. Upstanding lips 20 and 22 are also of sufficient length to deflect the water to adjacent water deflectors further down the edge of the roof.

Water deflector 10 is adapted to be placed between adjacent overlapping shingles on a shingled roof with the side edge 14 and upstanding lip 20 positioned along the outside edge of the roof. To securely fasten the water deflector 10 to the shingles, one or more sharp, raised tabs 24 are provided in base 12 near the rear edge 18. Each tab 24 points upward from base 12 and downward toward the front edge 16, thereby enabling the tabs 24 to securely engage the lower surface of a shingle located on top of base 12. In order to more securely fasten the water deflector 10 between overlapping shingles, one or more holes 26 may be provided in base 12. The holes 26 permit a roofing adhesive or mastic to extend through base 12 and form a continuous bond between the base 12 and adjacent shingles.

Figure 4:
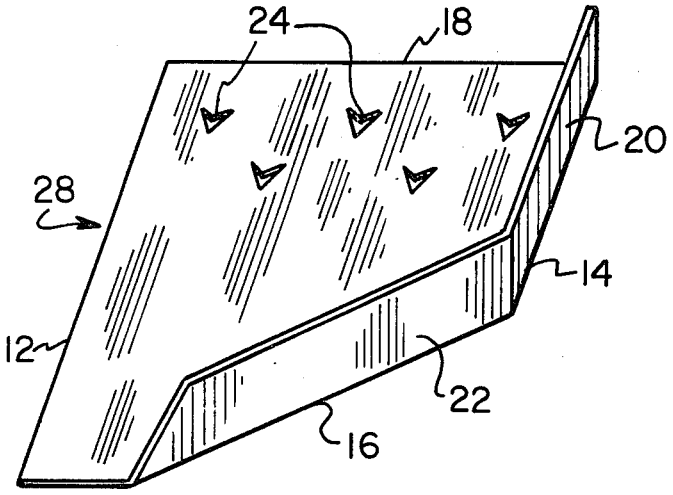
FIG. 4 is a perspective view of another embodiment of a water deflector.

The water deflector in accordance with the present invention may also be provided without holes 26 as shown in FIG. 4, although preferably the holes are included. The water deflector 10 shown in FIGS. 1–3 is adapted to be mounted along the left-hand edge of a downward sloping shingled roof. A water deflector 28 which is adapted to be mounted along the right-hand edge of a roof is shown in FIG. 4 wherein like numbers designate like parts. Water deflector 28 is essentially the mirror image of water deflector 10 shown in FIGS. 1–3 but without holes 26.

Figure 5:
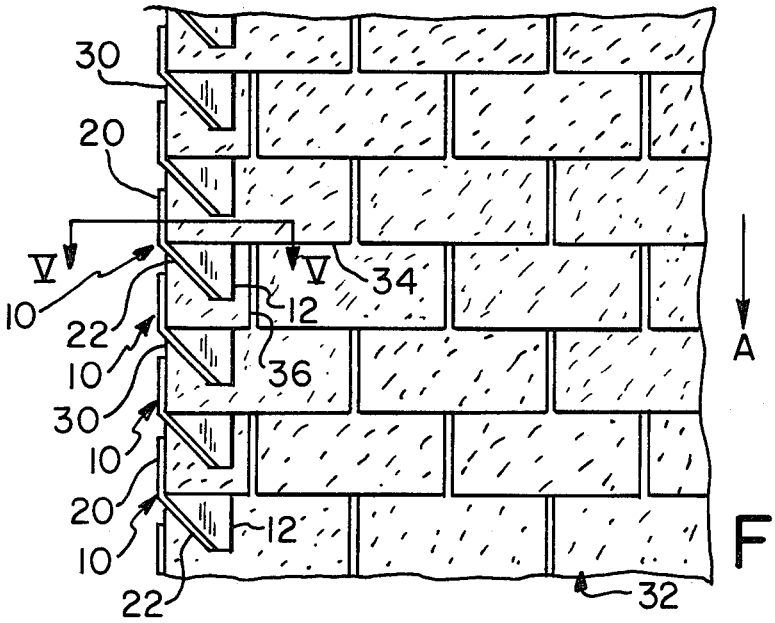
FIG. 5 is a top view partially cut away of a shingled roof with a plurality of water deflectors installed along one edge of the roof.

FIG. 5 shows a plurality of water deflectors 10 installed along the left-hand outside edge 30 of a portion of a shingled roof 32 which slopes downward in the direction of arrow A. Each water deflector 10 is located between adjacent overlapping shingles, e.g., upper shingle 34 and lower shingle 36, with upstanding lip 20 aligned along the roof outside edge 30, and upstanding lip 22 angled downward and away from the roof outside edge 30. The rear edge 18 (not shown) and the rear portion of base 12 are covered by the upper shingle 34.

In this manner, water flowing toward the outside edge 30 of the shingled roof 32 is continuously redirected down and away from this outside edge 30 and toward the next water deflector 10 further down the edge of the roof. Therefore, no water will flow over the outside edge 30.

Figure 6:
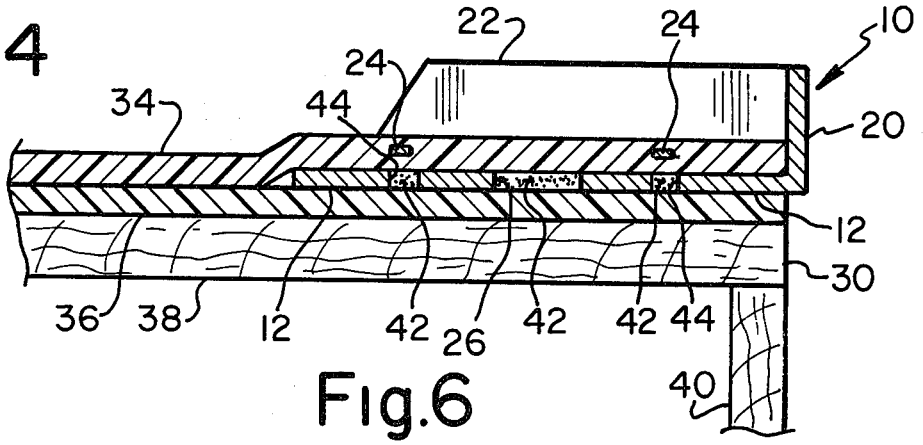
FIG. 6 is an enlarged section taken along line V—V of FIG. 5.

Referring now to FIG. 6, there is shown in section a roof base 38 and a house sidewall 40. Mounted to the roof base 38 is a lower shingle 36 with an upper shingle 34 overlapping the lower shingle 36. Together, pairs of upper and lower shingles 34 and 36 and the roof base 38 form the shingled roof 32 of FIG. 5. A water deflector 10 is positioned between the upper and lower shingles 34 and 36 with the first upstanding lip 20 aligned along the roof outside edge 30. The tabs 24 penetrate the upper shingle 34, thus securing the water deflector 10 to this shingle. The roofing adhesive or mastic 42 extends through the holes 26 in base 12 of the water deflector 10, bonds the upper and lower shingles 34 and 36 together, and further secures the water deflector 10 between the shingles 34 and 36. A small amount of mastic 42 may also penetrate base 12 through openings 44 formed by punching out tabs 24; however, this amount of mastic is insignificant when compared with the mastic which penetrates through the much larger holes 26.

The water deflector of the present invention is readily installed on an existing shingled roof or may be installed as shingles are being laid on a new roof. An upper shingle is merely lifted up along the ouside edge of the roof, the water deflector is positioned beneath and against the upper shingle and pulled forward slightly to engage the tabs, and the shingle with attached water deflector is returned to its original location on top of the lower shingle. This procedure is repeated for each upper shingle along the entire length of the roof edge.

The water deflector is preferably constructed from a continuous sheet of metal such as tin, stainless steel or the like, with the tabs and holes punched out or it may be made from several pieces of metal joined together by welding or the like. Additionally, the deflector may be molded from a variety of plastics, such as polypropylene, polyethylene, acrylonitrile-butadiene-styrene, polyester or the like.

Having described presently the preferred embodiments of the invention, it is to be understood that it may be otherwise embodied within the scope of the appended claims.

I claim:

1. In combination with a shingled roof including one or more pairs of upper and lower overlapping shingles, a deflector mounted between each pair of overlapping shingles along the edge of the roof, said deflector comprising:

(a) a substantially flat base with a side edge and a front edge extending at an angle from said side edge, (b) a first upstanding lip integral with said base along said side edge and substantially perpendicular to said base, and (c) a second upstanding lip integral with said base along said front edge and integral with said first lip and substantially perpendicular to said base, said upstanding lips forming a continuous deflector lip adapted to deflect liquid away from said edge of the roof.

2. The combination of claim 1 wherein said base includes at least one tab which engage the lower surface of an adjacent upper shingle and secure said base thereto.

3. The combination of claims 1 or 2 wherein said base includes at least one hole therethrough which permit mastic to extend through said base and form a continuous bond between said upper and lower shingles and said base located therebetween.

4. The combination of claim 1 wherein said front edge extends at an obtuse exterior angle from said side edge.

5. A deflector adapted to be mounted between overlapping shingles along the edge of a roof, said deflector comprising:

(a) a substantially flat base with a side edge and a front edge extending at an angle from said side edge, said base including at least one tab adapted to engage the lower surface of a shingle placed on top of said base and secure said base thereto, (b) a first upstanding lip integral with said base along said side edge and substantially perpendicular to said base, and (c) a second upstanding lip integral with said base along said front edge and integral with said first lip and substantially perpendicular to said base, said upstanding lips forming a continuous deflector lip adapted to deflect liquid.

6. The deflector of claim 5 wherein said base includes at least one hole therethrough.

7. The deflector of claims 5 or 6 wherein said front edge extends at an obtuse exterior angle from said side edge.

* * * * *